US011149323B2

(12) United States Patent
Schuering et al.

(10) Patent No.: US 11,149,323 B2
(45) Date of Patent: Oct. 19, 2021

(54) DEVICE AND METHOD FOR SENSING A CONVEYING RATE OF A LIQUID MATERIAL

(71) Applicant: SMS Group GmbH, Duesseldorf (DE)

(72) Inventors: Andreas Schuering, Mülheim (DE); Peter Starke, Duisburg (DE); Alexander Bergs, Rheine (DE)

(73) Assignee: SMS GROUP GMBH, Duesseldorf (DE)

( * ) Notice: Subject to any disclaimer, the term of this patent is extended or adjusted under 35 U.S.C. 154(b) by 197 days.

(21) Appl. No.: 16/304,334

(22) PCT Filed: May 16, 2017

(86) PCT No.: PCT/EP2017/061665
§ 371 (c)(1),
(2) Date: Nov. 26, 2018

(87) PCT Pub. No.: WO2017/202639
PCT Pub. Date: Nov. 30, 2017

(65) Prior Publication Data

US 2019/0136334 A1 May 9, 2019

(30) Foreign Application Priority Data

May 27, 2016 (DE) ..... 102016209238.3

(51) Int. Cl.
*C21C 5/52* (2006.01)
*F27D 3/14* (2006.01)
(Continued)

(52) U.S. Cl.
CPC ..... *C21C 5/527* (2013.01); *B22D 37/00* (2013.01); *C21C 5/4673* (2013.01); *C21C 5/50* (2013.01);
(Continued)

(58) Field of Classification Search
CPC ..... B22D 37/00; C21C 5/4673; C21C 5/50; C21C 5/527; F27B 3/18; F27B 3/28;
(Continued)

(56) References Cited

U.S. PATENT DOCUMENTS 1,374,750 A * 4/1921 McWane ..... B22D 13/107 164/114
4,135,915 A 1/1979 Kennard
(Continued)

FOREIGN PATENT DOCUMENTS

CA 2604767 10/2007
CA 2662412 3/2009
(Continued)

OTHER PUBLICATIONS

Yoshiyuki Noda et al. Optimal Sequence Control of Automatic Pouring System in Press Casting Process by using Greensand Mold, SICE-ICASE International Joint Conference, Oct. 18-21, 2006, Busan, Korea, 6 pages.
(Continued)

*Primary Examiner* — Jessee R Roe
*Assistant Examiner* — Michael Aboagye
(74) *Attorney, Agent, or Firm* — Abelman, Frayne & Schwab

(57) ABSTRACT

The invention relates to a device and to a method for sensing a conveying rate at which liquid material is filled into a metallurgical target vessel (6) from a pivotable starting vessel (4). For this purpose, means for determining an amount of liquid material with which the initial vessel (4) has been filled and means for sensing an amount of the liquid material which is discharged toward the target vessel (6) or filled into the target vessel (6) by pivoting of the starting vessel (4) are provided.

9 Claims, 8 Drawing Sheets

(51) Int. Cl.

| | |
|---|---|
| ***F27D 21/00*** | (2006.01) |
| ***F27D 19/00*** | (2006.01) |
| ***F27B 3/18*** | (2006.01) |
| ***F27B 3/28*** | (2006.01) |
| ***C21C 5/46*** | (2006.01) |
| ***C21C 5/50*** | (2006.01) |
| ***B22D 37/00*** | (2006.01) |
| *F27D 3/12* | (2006.01) |

(52) U.S. Cl.
CPC ..... *F27B 3/18* (2013.01); *F27B 3/28* (2013.01); *F27D 3/14* (2013.01); *F27D 19/00* (2013.01); *F27D 21/0035* (2013.01); *C21C 2005/468* (2013.01); *C21C 2005/5288* (2013.01); *F27D 21/0028* (2013.01); *F27D 2003/127* (2013.01); *F27D 2019/0059* (2013.01); *F27D 2019/0075* (2013.01)

(58) Field of Classification Search
CPC .. F27D 19/00; F27D 21/0028; F27D 21/0035; F27D 3/14
USPC ..... 266/78, 79, 99, 88; 222/590, 591, 604
See application file for complete search history.

(56) References Cited

U.S. PATENT DOCUMENTS

| | | | | |
|---|---|---|---|---|
| 4,191,885 | A * | 3/1980 | Rodriguez | B22D 2/00 177/1 |
| 6,004,504 | A | 12/1999 | Vallomy | |
| 7,770,628 | B2 * | 8/2010 | Simpson | B22D 37/00 164/457 |
| 8,202,472 | B2 | 6/2012 | Noda | |
| 8,875,960 | B2 * | 11/2014 | Terashima | B22D 41/06 222/604 |
| 9,618,265 | B2 | 4/2017 | Kemeny | |
| 2009/0230159 | A1 * | 9/2009 | Fleischanderl | C21C 5/50 222/590 |

FOREIGN PATENT DOCUMENTS

| | | | | |
|---|---|---|---|---|
| DE | 3532763 | | 3/1986 | |
| JP | 57201812 | * | 12/1982 | B22D 37/00 |

OTHER PUBLICATIONS

Indian Examination Report of Appl'n No. IN 201847048508, dated Aug. 11, 2020.

* cited by examiner

DEVICE AND METHOD FOR SENSING A CONVEYING RATE OF A LIQUID MATERIAL

CROSS-REFERENCE TO RELATED APPLICATIONS

This application is a National Stage application of International application PCT/EP2017/061665 filed May 16, 2017 and claiming priority of German applications DE 10 2016 209 238.3 filed May 27, 2016, both applications are incorporated herein by reference thereto.

FIELD OF THE INVENTION

The invention relates to a device for sensing a conveying rate at which liquid material is filled into a metallurgical target vessel from a pivotable starting vessel and to a corresponding method.

BACKGROUND OF THE INVENTION

According to the prior art, in the field of continuous steelmaking, it is known to continuously charge a furnace with a metallic charge. For this purpose, a method and a device are known, for example, from U.S. Pat. No. 6,004,504, wherein the metallic charge used in the process consists in particular of scrap metal in the form of solid particles. By means of a conveying rate detector, it is possible to determine the weight and the speed of the metallic charge supplied to a furnace. However, according to U.S. Pat. No. 6,004,504, a furnace can only be supplied with a solid or particulate metallic charge and not with liquid materials.

DE 10 2005 023 133 A1 discloses an installation for the measurement and the control of the charging of a furnace with molten material and scrap metal, and a corresponding method. Such an installation provides an automatic device for managing the charging of molten material or scrap metal as a function of the energy supplied to the bath, and a device for measuring the supplied molten material, which is associated with the automatic management device, wherein, for this purpose, a device for weighing the furnace, its content and possibly additional components weighing on said furnace is also provided. For a continuous control of the furnace weight, two measurement methods are possible, namely, on the one hand, a method based on the liquid metal level, for indirect control of the furnace weight, and, on the other hand, a direct method by means of which the weight of the installation is determined using appropriate sensors. The indirect measurement method is based on a geometric sensing of the liquid metal level within the furnace, wherein this data can be converted into volume data which then allows, if the specific density of the liquid metal is known, an inference of the weight of the liquid metal accommodated within the furnace. The indirect measurement method is only carried out, when the furnace is filled with the liquid metal, in order to determine, as explained, the level of the liquid metal within the furnace. If erosion occurs on the inner lining of the furnace as a consequence of an interaction with the liquid metal, the inner volume of the furnace can change, resulting disadvantageously in considerable inaccuracy for the indirect measurement method.

EP 2 061 612 B1 discloses a method for pouring a melt from a tiltable metallurgical vessel and a corresponding installation for carrying out this method. According to this prior art, a pouring of a melt from a tiltable metallurgical vessel into a receiving vessel can be carried out completely automatically, since the position of a melt pouring stream, which results from a determined tilting position of the metallurgical vessel, is determined in an automated manner, wherein, subsequently, as a function of the determined position of this pouring stream, the receiving vessel is brought into a position so as to accommodate the melt dumped from the metallurgical vessel. By a repositioning or moving the receiving vessel which is under the metallurgical vessel, the fact that the pouring stream of the melt also changes as a function of the tilting angle of the metallurgical vessel, which also changes as the pouring progresses, is taken into account. As a result, a fully automated pouring of the melt into the receiving vessel is then possible.

The prior art explained above has the underlying disadvantage either that the feed material with which the furnace is charged can be processed only in solid form or that, in the measurement method for the targeted charging of this feed material, an expensive weight determination of installation components including a lower vessel for a casting ladle is necessary.

SUMMARY OF THE INVENTION

Accordingly, the underlying aim of the invention is to sense, using simple means, the conveying rate of a liquid material at which the liquid material is filled into a metallurgical target vessel and, based on this, to also precisely set or regulate said conveying rate.

The above aim is achieved by a device having the features indicated in the claims.

A device according to the present invention is used for sensing a conveying rate at which a liquid material is filled into a metallurgical target vessel from a pivotable starting vessel and comprises means for determining an amount of liquid material with which the starting vessel has been filled and means for sensing an amount of liquid material which is discharged by pivoting of the starting vessel toward the target vessel.

A method according to the present invention is used for sensing a conveying rate of a liquid material at which the liquid material is filled into a metallurgical target vessel from a pivotable starting vessel, and is characterized by the following steps:

(i) determining an amount of liquid material which is contained or filled in the starting vessel, and (ii) sensing the amount of liquid material which is discharged toward the target vessel by pivoting of the starting vessel.

The invention is based on the essential finding that, using suitable means, the amount of liquid material which is discharged toward the target vessel by pivoting of the starting vessel can be sensed. In other words, this amount of liquid material is the conveying rate at which the liquid material is filled into the metallurgical target vessel. In one option, this conveying rate can be sensed volumetrically, for example, by means of scanning devices suitable for this purpose or the like. If a predetermined specific density of the liquid material is known, it is then possible to convert the sensed volume amount of the liquid material into a corresponding weight. In an alternative option, it is also possible to provide that the amount of liquid material which is discharged from the starting vessel toward the target vessel is sensed directly gravimetrically, for example, by a weighing device or the like, which can be designed in the form of a weight measurement cell.

Liquid materials whose conveying rate is sensed by means of a device or a method according to the present invention can in general be liquid substances, for example, pig iron, slag or the like, which can have a high temperature and possibly a low viscosity.

In one option, the liquid material can be filled directly into the target vessel during pivoting of the starting vessel. Alternatively, it is possible to arrange auxiliary means between the starting vessel and the target vessel, for example, a feed chute, wherein, when the starting vessel is pivoted toward the target vessel, the liquid material is first discharged into this feed chute, and then filled through this feed chute into the metallurgical target vessel. Here, it is possible for the feed chute to lead directly to the metallurgical vessel or for additional auxiliary means, for example, a conveying chute or the like, to be connected to the feed chute, by means of which a transport of the liquid material into the target vessel is ensured.

In an advantageous development of the invention, the means by which the amount of liquid material in the starting vessel is determined comprise a first scanning device. By means of such a scanning device it is possible to scan the starting vessel and its geometry, namely both when the starting vessel is still empty and also when the liquid material is filled into the starting vessel. The scanning of the starting vessel in the empty state is advantageous in particular for determining a possible accommodation volume of the starting vessel, because thereby a precise state of an inner wall of the starting vessel can be detected or determined. This is particularly advantageous if the starting vessel is a casting ladle whose inner wall as a rule has a lining which can be subjected to erosive wear due to contact with hot metal melt. In the sense of the present invention, it is advantageous if, before processing a new charge of liquid material, in the context of step (i) of the inventive method, the starting vessel is first scanned by the first scanning device in the empty state, i.e., when no liquid material is contained therein. Thereby, it is ensured that in each case a current potential accommodation volume of the starting vessel can be inferred.

In an advantageous development of the invention, at least one weighing device can be provided, with which the weight of the starting vessel is determined, namely while the starting vessel is tilted toward the target vessel in order to fill the liquid material into the target vessel. Such a weighing device can be integrated in a deposition stand on which the starting vessel can be positioned, or in a crane to which the starting vessel can be attached. By means of such a weighing device it is thus possible, based on the detected change in the weight of the starting vessel when said starting vessel is pivoted toward the target vessel and as a result the liquid material exits toward the target vessel, to infer the conveying rate at which the liquid material is filled into the metallurgical target vessel.

In an advantageous development of the invention, the means—by means of which the amount of liquid material discharged by pivoting of the starting vessel toward the target vessel is sensed—comprise a path measurement sensor or a position measuring device. Thereby, it is possible to determine a tilting movement with which the starting vessel is pivoted toward the target vessel, namely with regard to a tilting angle as well as a tilting speed for the starting vessel.

The above-mentioned first scanning device can be arranged and designed in such a manner that hereby a filling height at which the liquid material is filled within the starting vessel can be determined. Optionally it is possible that, with such a scanning device, a change in the filling height within the starting vessel is sensed while the starting vessel is pivoted toward the target vessel and in the process the liquid material exits from the starting vessel.

Additionally and/or alternatively, according to an advantageous development of the invention, a second scanning device can be provided, which is directed onto the feed chute arranged between the starting vessel and the target vessel. By means of the second scanning device, the feed chute is scanned in order to determine a filling height of the liquid material therein while the starting vessel is pivoted toward the target vessel and thereby the liquid material flows into the feed chute. In this context, it may be pointed out that the geometry of the feed chute and its inclination toward the target vessel are known. On the basis of this, it is possible, using a filling height of the liquid material within the feed chute determined by the scanning device, to infer the volume or the conveying rate of the liquid material with or at which the liquid material is filled into the target vessel.

In an advantageous development of the invention, in step (ii), a tilting speed for the starting vessel is set by selection or regulation in such a manner that the conveying rate at which the liquid material exits from the starting vessel toward the target vessel is substantially constant. Thereby, it is possible that the liquid material is filled into the metallurgical target vessel at a predetermined conveying rate. Due to the adjustment of the tilting speed of the starting vessel, a decrease in the filling height of the liquid material within the starting vessel, which occurs when the liquid material exits from the starting vessel, is appropriately compensated for in order to achieve a desired conveying rate.

It may be pointed out that, in the case of a furnace amongst others for steelmaking, the device according to the present invention can either be provided as original equipment or it can have been retrofitted. In any case, the essential components of the device according to the invention are formed by the means for determining an amount of liquid material which is has been filled in the starting vessel and by the means for sensing an amount of liquid material which is discharged by pivoting of the starting vessel toward the target vessel. In contrast, the starting vessel and the target vessel themselves are not necessarily part of the device according to the invention.

BRIEF DESCRIPTION OF THE DRAWINGS

Below, preferred embodiments of the invention are described in detail in reference to a schematically simplified drawing.

In the drawing.

DETAILED DESCRIPTION OF THE PREFERRED EMBODIMENT

Figure 1:
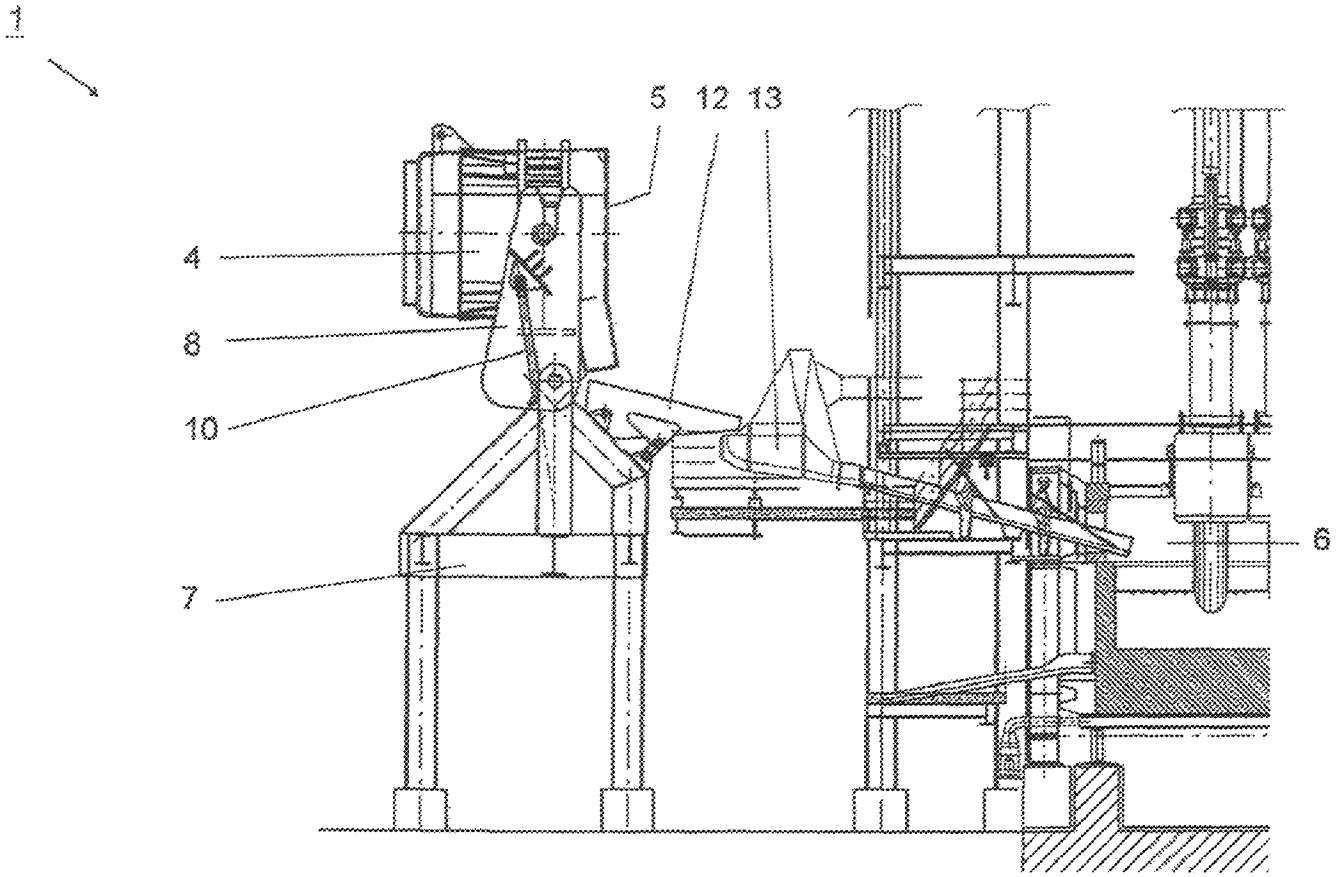
FIG. 1 shows a simplified side view, with partial cutaway, of a metallurgical furnace and of a pivotable casting ladle associated with the furnace, FIG. 2-4 in each case show side views of the casting ladle of FIG. 1 in different pivoted positions in relation to the metallurgical furnace, for illustrating an embodiment of the invention.

FIG. 1 shows, in a side view, simplified and with partial cutaway, a portion of a furnace used, for example, for steelmaking, and an associated casting ladle which is arranged so that it can pivot toward the furnace. The invention can be used with such a furnace as explained in detail below.

The subject matter of the present invention is based on the fact that thereby a conveying rate at which a liquid material is filled from a pivotable starting vessel into a metallurgical target vessel is sensed. For explanation of the invention, in reference to FIG. 1, a pivotable starting vessel is always understood to mean a casting ladle, and a metallurgical target vessel is always understood to mean a furnace, without being limited to such components or elements.

Figure 2:
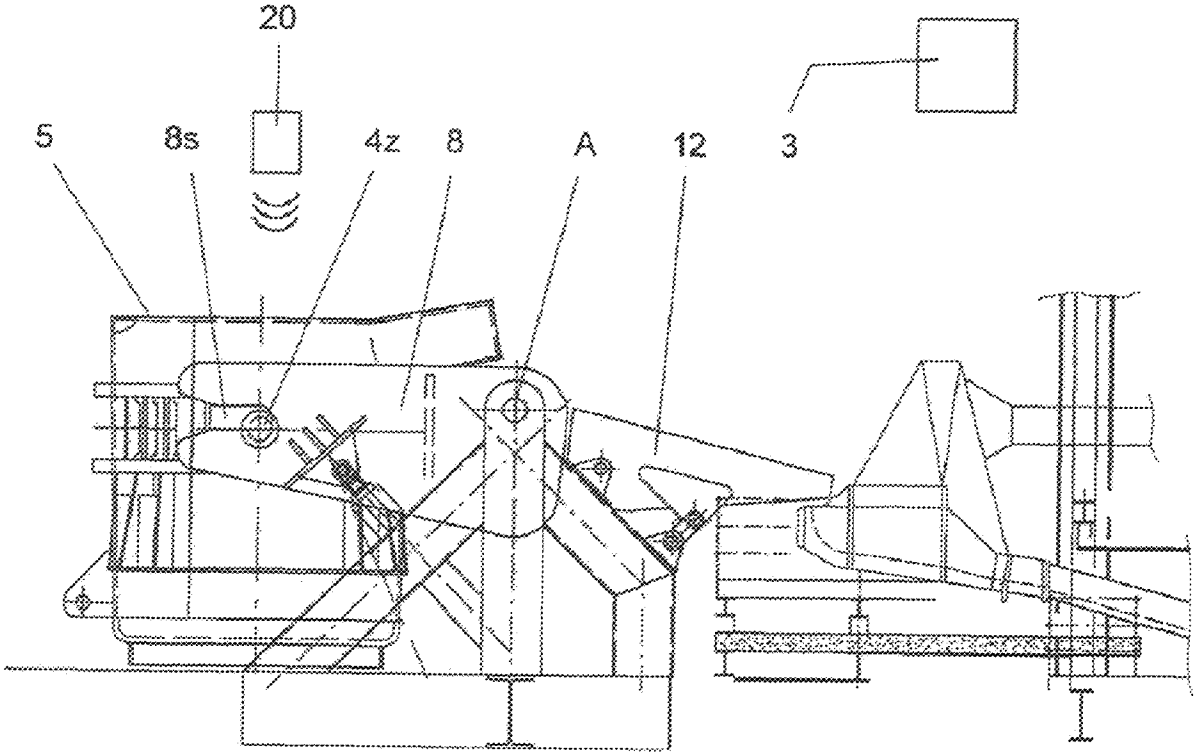
Figure 3:
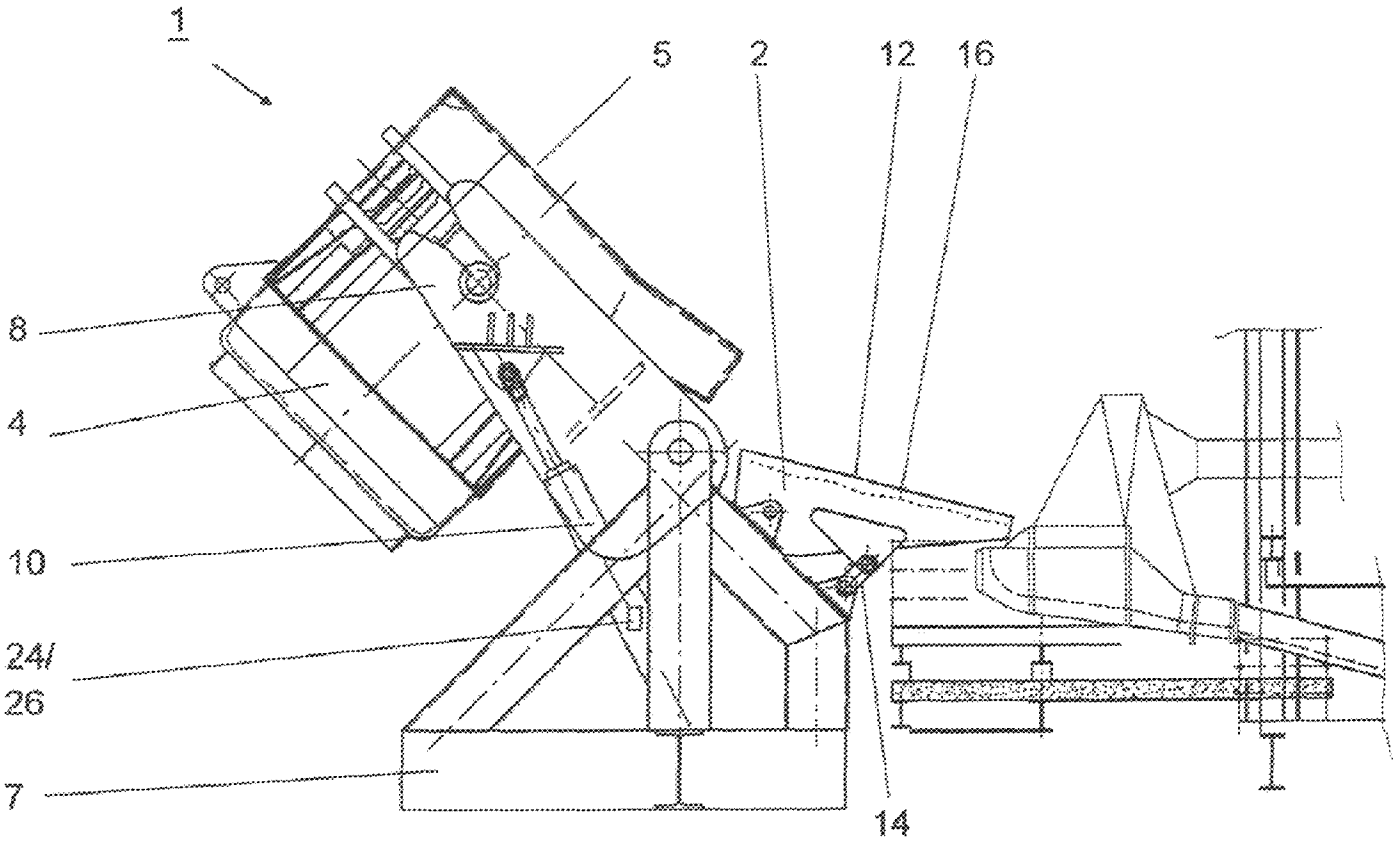
Figure 4:
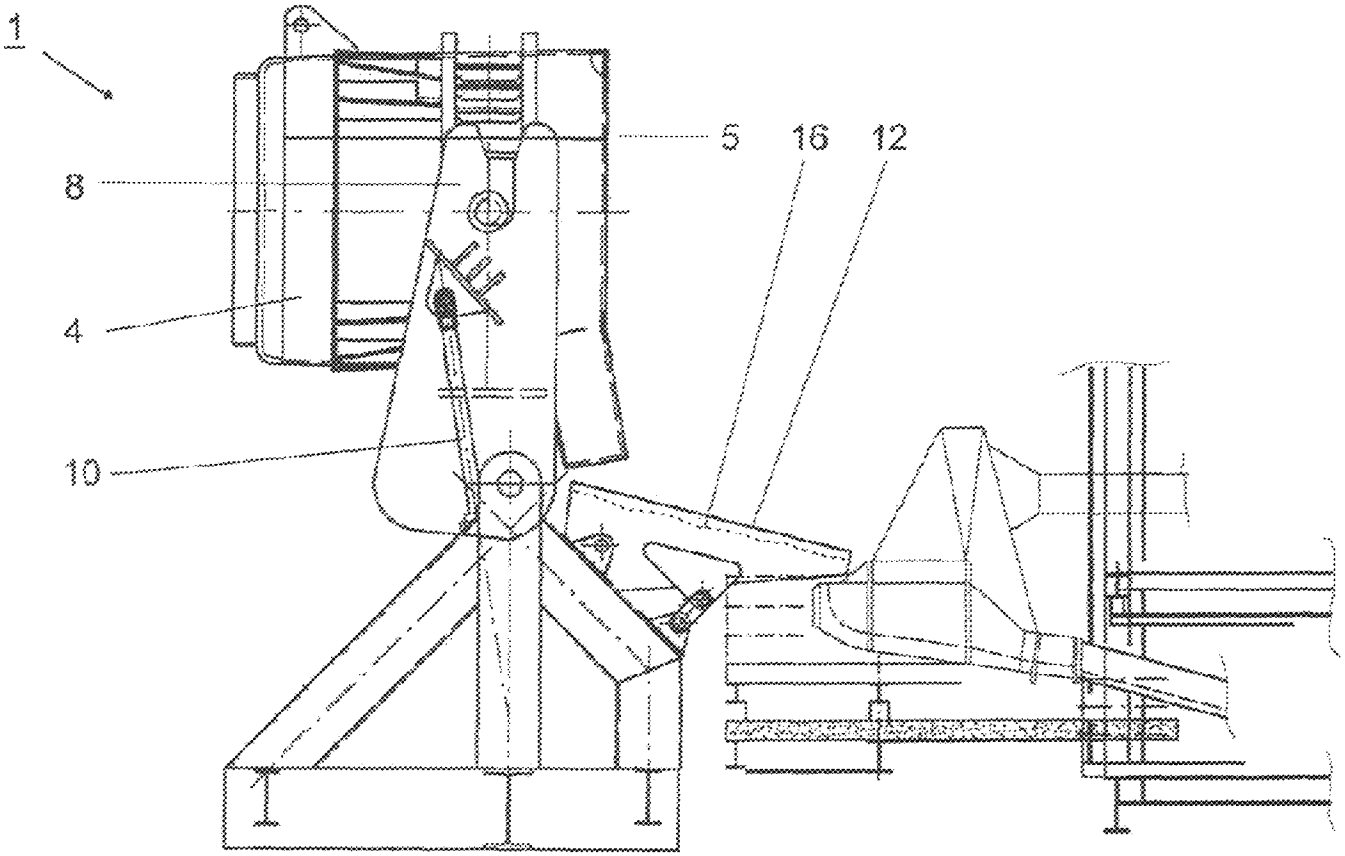

FIG. 2-4 illustrate a first embodiment of an inventive device 1 and show a casting ladle 4 of FIG. 1 in different operating positions in relation to a furnace 6 with which the casting ladle 4 is associated. The casting ladle 4 can be pivoted toward the furnace 6. In particular, the casting ladle 4 is shown in a starting position (FIG. 2), in an intermediate position (FIG. 3), and in a final position (FIG. 4). Starting from the starting position according to FIG. 2, pivoting of the casting ladle 4 toward the furnace 6 is used for the purpose of discharging a liquid material, for example, liquid pig iron, from the casting ladle 4 toward the furnace 6 and filling it into the furnace 6 preferably at a predetermined conveying rate.

Adjoining the furnace 6, a ladle deposition stand 7 is positioned, which has a pair of holding arms 8 which are pivotable around a horizontal axis A. On a free end of the holding arm 8, blind grooves 8*s* (FIG. 2) are formed in each case. On opposite sides of the casting ladle, guiding pins 4*z* (FIG. 2) are attached in each case. Thus it is possible to hook in the casting ladle 4 between the holding arms 8 in that the guiding pins 4*z* are hooked into the blind grooves 8*s* of the two holding arms 8.

The ladle deposition stand 7 comprises at least one hydraulic cylinder 10 which is articulated to one of the two holding arms 8. Advantageously, a separate hydraulic cylinder 10 is associated with each of the two holding arms 8, which cannot be seen in the side views of the drawing. By an actuation of the hydraulic cylinder(s) 10, it is possible to pivot the holding arms 8. Here, at the same time, a pivoting of the casting ladle 4 around the axis A into different operating positions occurs, since the position of the casting ladle 4, after it has been hooked in between the holding arms 8, is secured relative to the holding arms 8 and does not change.

Between the ladle deposition stand 7 and the furnace 6, a feed chute 12 is arranged, the course of which is inclined downward toward the furnace 6. Adjoining the feed chute 12, a conveying chute 13 which leads to the furnace 6 is provided. The feed chute 12 is connected by articulation by means of an articulated lever 14 (FIG. 3) to a frame construction of the ladle deposition stand 7, whereby the inclination of the feed chute 12 toward the furnace 6 can be changed by an adjustment of the articulated lever 14, preferably by motor.

If liquid material is filled into the casting ladle 4 and subsequently the casting ladle 4 is pivoted from its starting position (FIG. 2) around the axis A by an actuation of the hydraulic cylinder 10 and thus tilted toward the furnace 6, for example, into the intermediate position according to FIG. 3, the liquid material exits then from an opening 5 of the casting ladle 4 into the feed chute 12. In FIG. 3, a filling height to which the feed chute 12 is filled by the liquid material 2 is symbolized by a dotted line 16. The liquid material 2 flows from the feed chute 12 into the conveying chute 13 connected thereto and subsequently reaches the interior of the furnace 6. The resulting filling height 16 for the liquid material 2 within the feed chute 12 is set by the tilting angle of the casting ladle 4 and possibly by the inclination angle of the feed chute 12.

In FIG. 4, the casting ladle 4 is pivoted into its final position, namely by a corresponding actuation of the hydraulic cylinder 10 and a resulting movement of the holding arms 8. In this final position, it is ensured that the liquid material 2 flows substantially completely out of the casting ladle 4 and is filled as intended into the furnace 6. In FIG. 4, in the same way as in FIG. 3, a filling height 16 to which the feed chute 12 is filled with the liquid material 2 is symbolized by a dotted line. Additionally, it may be pointed out that the casting ladle 4 is also pivoted into its final position in the representation of FIG. 1.

The device 1 comprises means 18 for determining an amount of liquid material which is filled into the starting vessel in the form of the casting ladle 4.

These means 18 comprise, for example, a first scanning device 20 (FIG. 2), with which the casting ladle 4 can be scanned when said casting ladle is filled with the liquid material 2. Additionally, it is possible to scan the casting ladle 4 and its geometry by means of the first scanning device 20 in order to determine thereby an exact value for the inner volume of the casting ladle.

Figure 5:
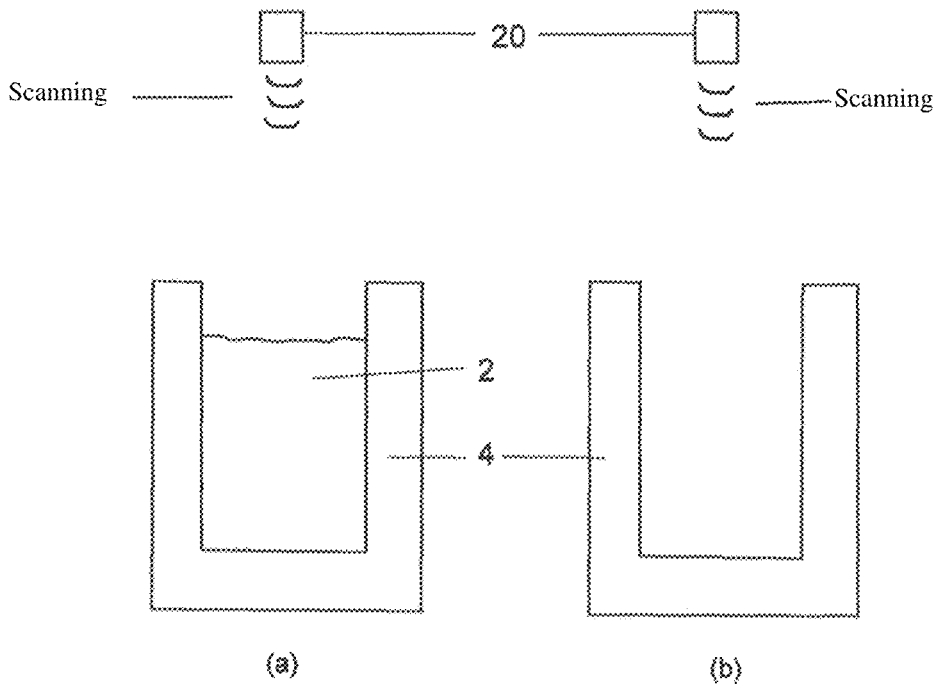
FIG. 5 shows highly simplified cross-sectional views of a casting ladle, (a) when a liquid material is filled into said casting ladle, and (b) when the casting ladle is empty.

FIG. 5 shows a highly simplified cross-sectional view of the casting ladle 4. In the representation (a) of FIG. 5, the casting ladle 4 is scanned by means of the first scanning device 20 when liquid material 2 is filled into the casting ladle 4. In the representation (b) of FIG. 5, the casting ladle 4 in the empty state is scanned by means of the first scanning device 20. By scanning the casting ladle 4 when it is empty and thus no liquid material is filled into it, it is possible to determine an exact inner volume for the casting ladle 4, also taking into consideration possible wear of its lining on the inner circumferential surface. For the present invention it is advantageous to scan the casting ladle 4 always in an empty state, before liquid material 2, for example as next charge of pig iron, is again filled into it.

If an exact inner volume of the casting ladle 4 is known, which is determined, as explained, by scanning the empty casting ladle 4, it is then possible to infer the amount of liquid material filled into the casting ladle 4 by scanning the filling height to which the casting ladle 4 is filled with liquid material 2. This amount can be calculated as a volume, wherein, based on a predetermined specific density of the liquid material, the weight of the liquid material within the casting ladle 4 can thus also be determined.

The device 1 comprises additional means 24 for sensing an amount of liquid material which is discharged during pivoting of the casting ladle 4 toward the furnace 6.

The means 24 can comprise a sensor 26 for path measurement sensing which is provided on the hydraulic cylinder 10. By means of this sensor 26, it is possible to determine an exact position of the holding arms 8 and thus also of the casting ladle 4 hooked therein. Based on this, it is possible to measure a tilting movement of the casting ladle 4, namely both with regard to a tilting angle and also with regard to a tilting speed relative to the furnace 6.

The invention then works as follows:

Before the processing of a charge of liquid material 2 in the form of pig iron, for example, the casting ladle 4 is scanned first in the empty state by means of the scanning device 20 in order to determine exactly the inner volume of the casting ladle 4. Subsequently, the liquid material 2 is filled into the casting ladle 4, wherein, by means of the scanning device 20, the filling height for the liquid material 2 within the casting ladle is then determined. Then, starting from its starting position according to FIG. 2, the casting ladle 4 is tilted around the axis A toward the furnace 6 and in the process, via an intermediate position (FIG. 3), reaches its final position (FIG. 4). As already explained, in the process, the liquid material 2 flows out of the opening 5 of the casting ladle 4 into the feed chute 12 and finally into the furnace 6. The speed at which the casting ladle 4 is tilted around the axis A toward the furnace 6 is calculated beforehand, taking into consideration the filling height or the filling weight of the liquid material accommodated in the casting ladle 4, and is set appropriately by an actuation of the hydraulic cylinder 10.

Figure 6:
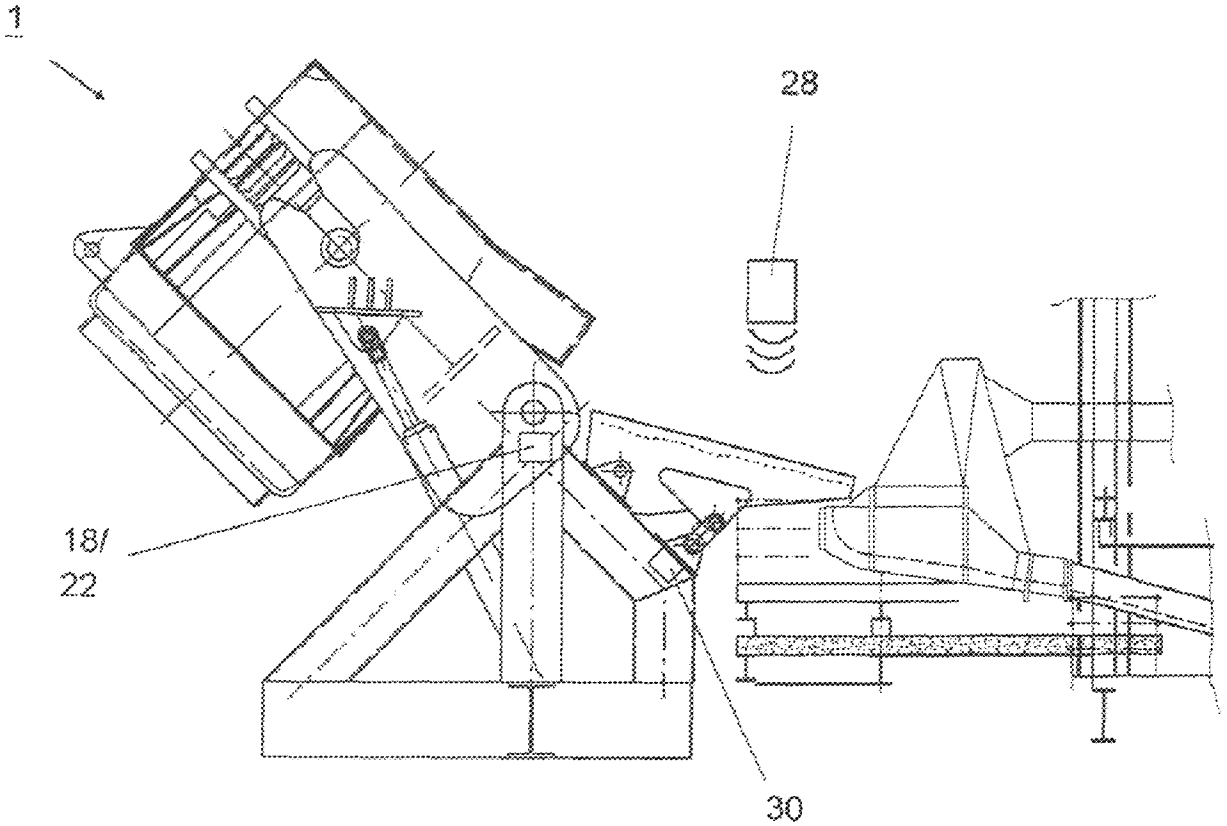
FIG. 6 shows a side view of a casting ladle for illustrating an additional embodiment of the invention.

Additional embodiments of the invention are explained below in reference to the representation according to FIG. 6.

The means 24 can also comprise a first weighing device 22 which can be provided alternatively or additionally to the scanning device 20. The first weighing device 22 is integrated in the ladle deposition stand 7 and enables a determination of the weight of the casting ladle 4 hooked into the holding arms 8, namely both in the starting position of the casting ladle and also during the pivoting around the axis A. Taking into consideration the change in the weight of the casting ladle 4 which results as a consequence of an exit of the liquid material 2 during the pivoting of the casting ladle around the axis A, the amount of liquid material which is filled into the furnace 6, i.e., the conveying rate, can be determined by calculation.

By means of the first weighing device 22, it is also possible to determine the weight of the liquid material 2 filled into the casting ladle 4 when said casting ladle is in its starting position according to FIG. 2. This occurs in a simple way by a measurement of the weight of the casting ladle 4 in an empty state and subsequently in a filled state together with the liquid material 2. To that extent, the first weighing device 22 is also a component of the means 18.

Figure 7:
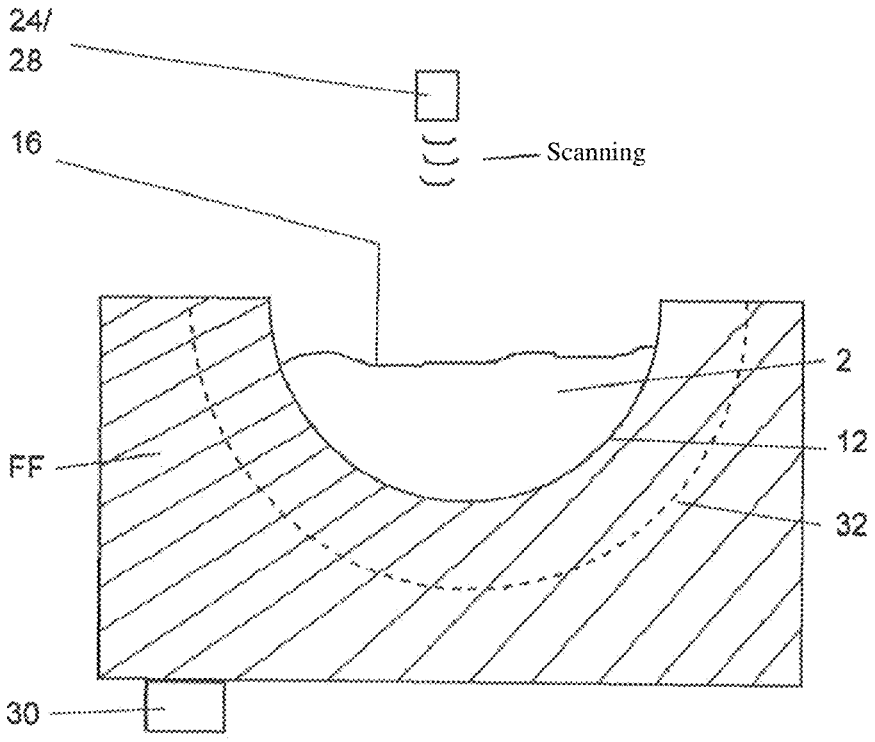
FIG. 7 shows a simplified cross-sectional view of a feed chute which leads to the furnace of FIG. 1.

According to an additional embodiment of the invention, the means 24 can comprise a second scanning device 28 with which the filling height 16 for the liquid material 2 within the feed chute 12 is determined. FIG. 7 shows a simplified cross-sectional view of the feed chute 12 and illustrates that the second scanning device 28 is positioned, for example, above the feed chute 12, in order to scan the feed chute 12 and thereby sense the filling height 16 for the liquid material 2. In this context, it may be pointed out in regard to the feed chute 12 that its geometry (in a plane orthogonal to the flow direction of the liquid material) and its inclination angle toward the furnace 6 are known.

According to an additional embodiment of the invention, it is possible to provide that the means 24, additionally or alternatively to the second scanning device 28, comprise a second weighing device 30 which is shown only symbolically in a highly simplified manner in the representation of FIG. 7. By means of the second weighing device 30, the weight in the feed chute 12 can be determined continuously when, during a pivoting of the casting ladle 4 around the axis A, the liquid material 2 exits from the casting ladle 4 into the feed chute 12. Based on the measurement of the weight of the feed chute 12 when the liquid material 2 flows through the feed chute 12, it is then possible, by a comparison with a previously determined weight of the feed chute 12 when said feed chute is empty and no liquid material is contained therein, to infer the conveying rate at which the liquid material 2 is filled into the furnace 6 through the feed chute 12.

According to an additional embodiment of the invention, it is possible to provide that, additionally or alternatively to the second scanning device 28 or to the second weighing device 30, the means 24 comprise measuring loops 32 which are embedded in the fireproof (FF) material from which the feed chute 12 is manufactured (compare FIG. 7). If the feed chute 12 is run through by a flow of liquid material in the form of pig iron, electrical fields are induced in the measuring loops 32, by means of which the resulting filling height 16 for the pig iron within the feed chute 12 can be determined.

Based on the filling height 16 for the liquid material 2 within the feed chute 12, which filling height 16 is sensed by the second scanning device 28 and/or by the measuring loops 32, it is then possible to infer the amount or conveying rate at which the liquid material 2 flows through the feed chute 12 and is subsequently filled into the furnace 6.

Figure 8:
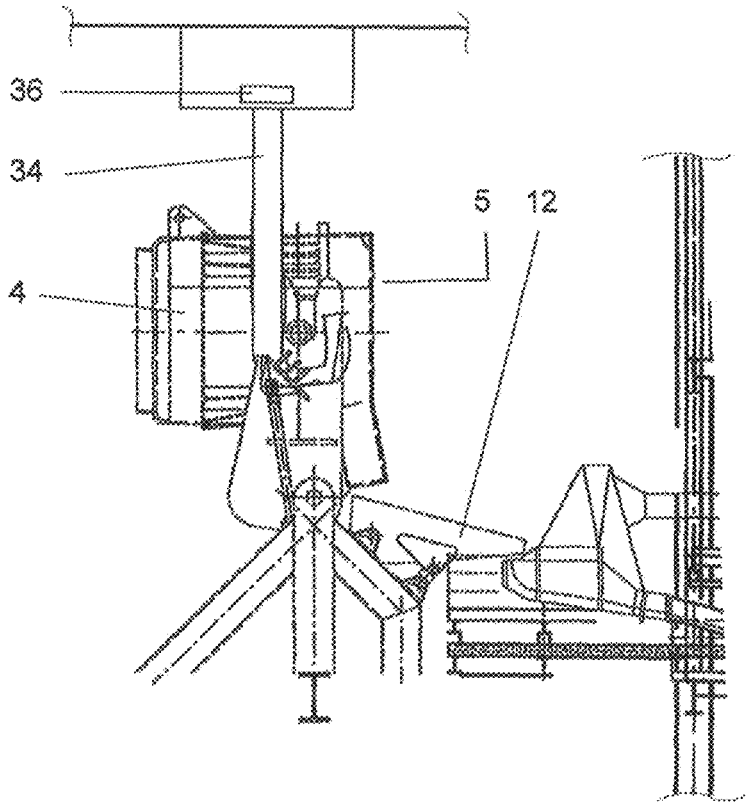
FIG. 8 shows a simplified side view of a casting ladle for illustrating an additional embodiment of the invention.

According to an additional embodiment of the invention, it is possible to provide that the casting ladle 4 is hooked on a crane 34. This is shown in a simplified manner in a side view of FIG. 8 which shows a portion of a furnace 6 according to FIG. 1. With the aid of an auxiliary lift which can be adjusted for the crane 34, the casting ladle 4 can be tilted or pivoted toward the furnace 6 in a controlled manner, in the same way as represented and explained in FIG. 3 and FIG. 4, so that, as a result, the liquid material 2 can be filled from the casting ladle 4 through the feed chute 12 into the furnace 6.

A third weighing device 36 can be integrated in the crane 34, by means of which the change in the weight for the casting ladle 4 is determined when said casting ladle is pivoted toward the furnace 6 and in the process liquid material 2 exits from the casting ladle 4. The measured change in the weight for the casting ladle 4, just as in the case of the measurement with the first weighing device 22, is a measure for the conveying rate in the form of a mass flow with which the liquid material 2 is filled into the furnace 6.

With respect to the means 24, it may be pointed out that the above-explained scanning device 28, the weighing devices 22, 30, 36 and the measuring loops 32 can be used alternatively or cumulatively, in order to determine as a result, the conveying rate at which the liquid material 2 is filled into the furnace 6. In the case of a cumulative use of these elements, an improved accuracy with regard to a sensing and setting of the conveying rate for the liquid material 2 is ensured.

In reference to the drawing, it may be pointed out that the scanning devices 20, 28 shown therein are represented in a highly simplified and only symbolic manner.

Finally, for all the above embodiments of the invention, it may be pointed out that the device 1 also comprises a control unit 3 which is only indicated symbolically, for example, in FIG. 2, for the purpose of simplification. All the mentioned scanning devices, weighing devices and path measurement sensors or sensors are connected via data lines (not shown) to the control unit 3 so that their signals can be processed in the control unit 3. Based on this, a suitable control or regulation of the hydraulic cylinder 10 for the setting of a desired tilting speed for the casting ladle 4 is possible, since the hydraulic cylinder 10 is also connected to the control unit 3. As a result, a predetermined conveying rate at which a liquid material 2 is filled into the furnace 6 can be achieved.

LIST OF REFERENCE NUMERALS

1 Device
2 Liquid material
3 Control

4 Casting ladle/starting vessel
4*z* Guiding pin
5 Opening (of the casting ladle)
6 Furnace/metallurgical target vessel
7 Ladle deposition stand
8*s* Blind groove
8 Holding arms
13 Conveying chute
10 Hydraulic cylinder
12 Feed chute
14 Articulated lever
16 Filling height
18 Means for determining an amount of liquid material
20 First scanning device
22 First weighing device
24 Means for sensing the amount of liquid material
26 Sensor, for path measurement sensing
28 Second scanning device
30 Second weighing device
32 Measuring loop
34 Crane
36 Third weighing device
A (Horizontal) axis
FF Fireproof material (for the feed chute 12)

The invention claimed is:

1. A device for sensing a conveying rate at which a liquid material in a form of pig iron is filled into a metallurgical target vessel from a pivotable starting vessel, the device comprising:

means for determining an amount of liquid material which has been filled into the starting vessel;

a sensor for sensing an amount of liquid material which is discharged toward the target vessel by pivoting of the starting vessel;

a feed chute formed of a fireproof material and having a wall including at least one measuring loop provided therein to generate electric fields, the feed chute being positioned between the starting vessel and the target vessel; and wherein the sensor detects the electric fields in the feed chute occurring in response to a flow and volume of the liquid material in the feed chute, said electric fields being monitored by said sensor to determine the conveying rate at which the liquid material is filled into the metallurgical target vessel.

2. The device according to claim 1, wherein the determining means by which the amount of liquid material in the starting vessel is determined comprises a first scanning device, wherein the starting vessel and its geometry is scanned by the first scanning device when the starting vessel is empty, as well as when the liquid material has been filled into said starting vessel.

3. The device according to claim 1, wherein the determining means comprises at least one weighing device by which the weight of the starting vessel is determined while the starting vessel is tilted in a direction of the target vessel in order to fill the liquid material into the target vessel.

4. The device according to claim 3, wherein the weighing device is integrated in a deposition stand on which the starting vessel is positioned.

5. The device according to claim 3, wherein the weighing device is integrated in a crane to which the starting vessel is attached.

6. The device according to claim 1, wherein the sensor further comprises a path measurement sensor to detect a tilting movement with which the starting vessel is pivoted in a direction of the target vessel.

7. The device according to claim 6, wherein, by the path measurement sensor, both a tilting angle and a tilting speed at which the starting vessel is pivoted in the direction of the target vessel is determined.

8. The device according to claim 1, wherein the sensor comprises a second scanning device to determine a filling height of the liquid material within the feed chute.

9. The device according to claim 1, wherein the sensor comprises a weighing device to measure the weight of the feed chute arranged between the starting vessel and the target vessel is measured.

* * * * *